United States Patent [19]

de Groot

[11] Patent Number: 4,570,537

[45] Date of Patent: Feb. 18, 1986

[54] PRINTING APPARATUS WITH ARTICLE DRIVEN TEXT ROLL

[75] Inventor: Jacobus H. de Groot, Noordwijkerhout, Netherlands

[73] Assignee: B.V. Korthofah, Netherlands

[21] Appl. No.: 645,613

[22] Filed: Aug. 29, 1984

[30] Foreign Application Priority Data

Aug. 31, 1983 [NL] Netherlands ..... 8303030

[51] Int. Cl.[4] ..... B41F 17/26

[52] U.S. Cl. ..... 101/35; 101/212

[58] Field of Search ..... 101/35, 36, 37, 328, 101/329, 330, 331, 212

[56] References Cited

U.S. PATENT DOCUMENTS

| | | | |
|---|---|---|---|
| 2,952,204 | 9/1960 | Sherman | 101/35 |
| 3,092,019 | 6/1963 | Van Buskirk . | |
| 3,112,690 | 12/1963 | Talarico | 101/35 |
| 3,294,015 | 12/1966 | Gartside et al. . | |
| 3,327,624 | 6/1967 | Beaver | 101/35 |
| 3,808,970 | 5/1974 | Delligatti . | |

FOREIGN PATENT DOCUMENTS

| | | |
|---|---|---|
| 2653069 | 5/1978 | Fed. Rep. of Germany . |
| 858879 | 1/1961 | United Kingdom . |

*Primary Examiner*—Clifford D. Crowder

*Attorney, Agent, or Firm*—Pahl, Lorusso & Loud

[57] ABSTRACT

A printing apparatus for applying a coding on a surface which is transported past the printing apparatus, comprising a text roll for the coding characters, supported by a frame and rotatably mounted on a shaft. Said text roll is drivable by the passing surface. The printing apparatus further comprises a rotatable inking means for inking the coding characters. The text roll is movable backwards and forwards in radial direction, wherein a driving means is provided for rotating the text roll and moving the text roll in radial direction from a rest position, in which the text roll is completely free of the surface to be coded, to a working position, in which the text roll engages the surface to be coded, when a surface to be coded comes up to the text roll. The driving means is adapted to return the text roll in radial direction and to rotate the text roll to the rest position from an end position reached by the coding operation after applying the coding.

10 Claims, 6 Drawing Figures

PRINTING APPARATUS WITH ARTICLE DRIVEN TEXT ROLL

The invention relates to a printing apparatus for applying a coding on a surface which is transported past the printing apparatus, comprising a text roll for the coding characters supported by a frame and rotatably mounted on a shaft, which text roll can be driven by the passing surface, and a rotatable inking means for inking the coding characters, wherein means are provided for bringing the text roll in a rest position each time after applying a coding.

At a known apparatus of this type said means comprises an excentric disc mounted on the shaft of the text roll, which excentric disc is loaded by a ball bearing on which a force is exerted by a spring. Thereby the text roll will rotate further after the ball bearing has passed the uppermost point of the excentric disc, until the ball bearing engages the lowermost point of the excentric disc. Normally a recess is provided in said lowermost point of the excentric disc. In order to guarantee a good operation of the printing apparatus the text roll has to make at least half a revolution so that the circumference of the text roll is dependent on the size of the passing surface of the product to be coded. Further it takes relatively much time to move the text roll to the rest position, whereby the number of codings per minute is not very high. Moreover, this known printing apparatus is not suitable for coding packagings which are still contained in a material web.

The invention aims to provide a printing apparatus of the above-mentioned kind, wherein said disadvantages are obviated in a simple but nevertheless effective way.

To this end the printing apparatus according to the invention is characterized in that the text roll is movable backwards and forwards in radial direction, wherein a driving means is provided for rotating the text roll and moving the text roll in radial direction from the rest position, in which the text roll is completely free of the surface to be coded, to a working position, in which the text roll engages the surface to be coded, when a surface to be coded comes up to the text roll, and in that the driving means is adapted to return the text roll in radial direction and to rotate the text roll to the rest position from an end position reached by the coding operation after applying the coding.

Thereby it is obtained that the circumference of the text roll can be chosen independent of the size of the passing surface. Moving the text roll to the rest position goes very quick. Moreover the printing apparatus can be used for applying codings on a surface which is still contained in a material web, because the text roll is returned in radial direction each time after applying a coding and thus is disengaged from the surface.

Preferably, the inking means is located in rotational direction of the text roll between the rest position and the working position.

Thereby it is obtained that at a suitable location of the coding characters on the circumference of the text roll the first coding characters are already inked by the rotation of the text roll to the working position before the text roll engages the surface to be coded.

According to a favourable embodiment of the invention the driving means operates a stop block movable backwards and forwards, said stop block having a first recess adapted to cooperate with a pin of the text roll, wherein the shaft of the text roll is borne in a bearing block movable backwards and forwards in the same direction as the stop block, said bearing block being movable by the stop block, wherein said stop block is adapted to rotate the text roll to the working position by means of the pin during the forward motion and to move the bearing block together with the text roll during the last part of the forward motion, whereas the bearing block is returned by a return means during the first part of the backward motion of the stop block, the stop block further being coupled by a coupling member to the text roll for rotating the text roll to the rest position determined by said recess during the remaining part of the backward motion.

The invention will be further explained by reference to the drawings in which an embodiment of the printing apparatus of the invention is shown.

Figure 1:
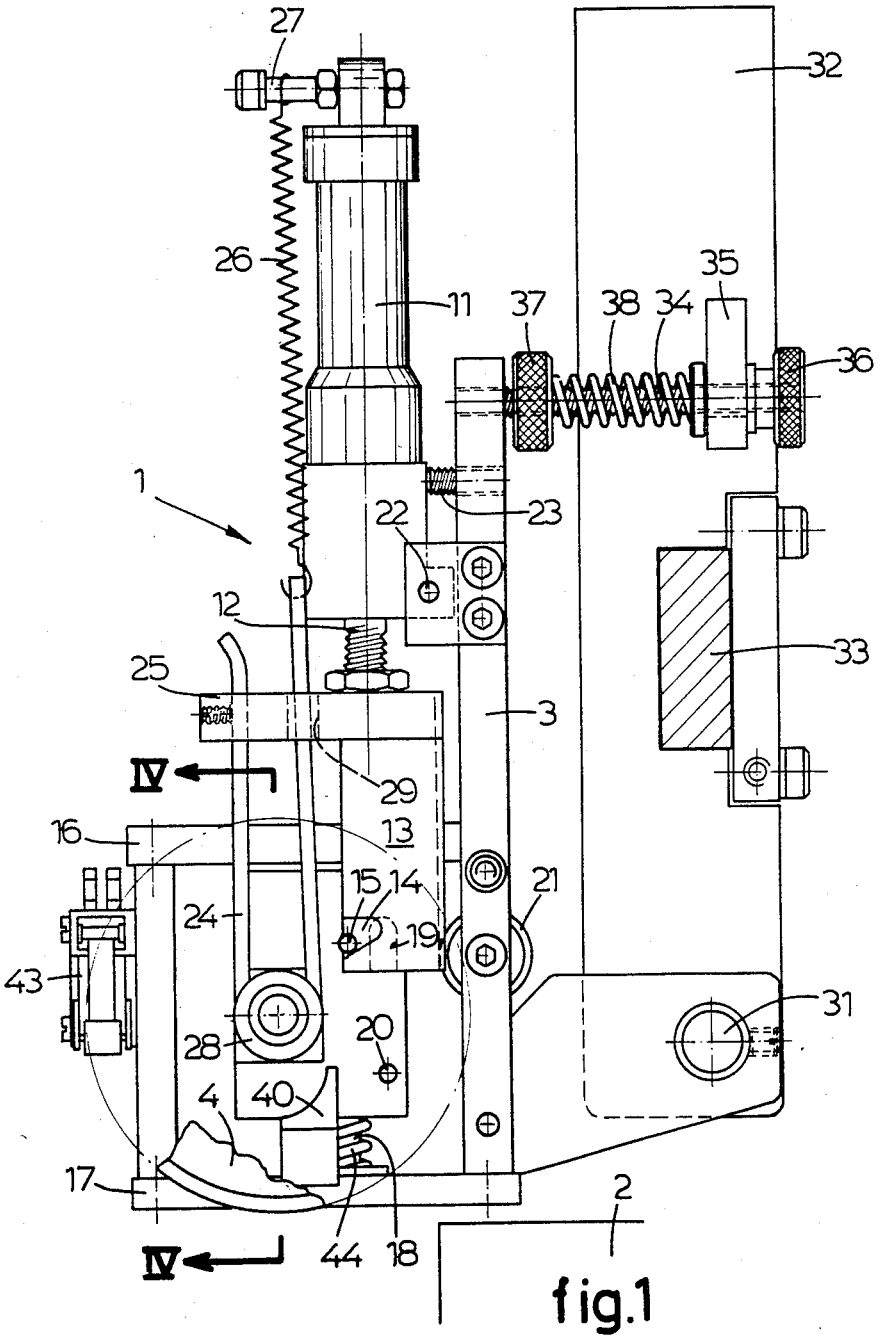
FIG. 1 shows a schematical side view of an embodiment of the printing apparatus of the invention, wherein the only partially shown text roll is in the rest position.
Figure 5:
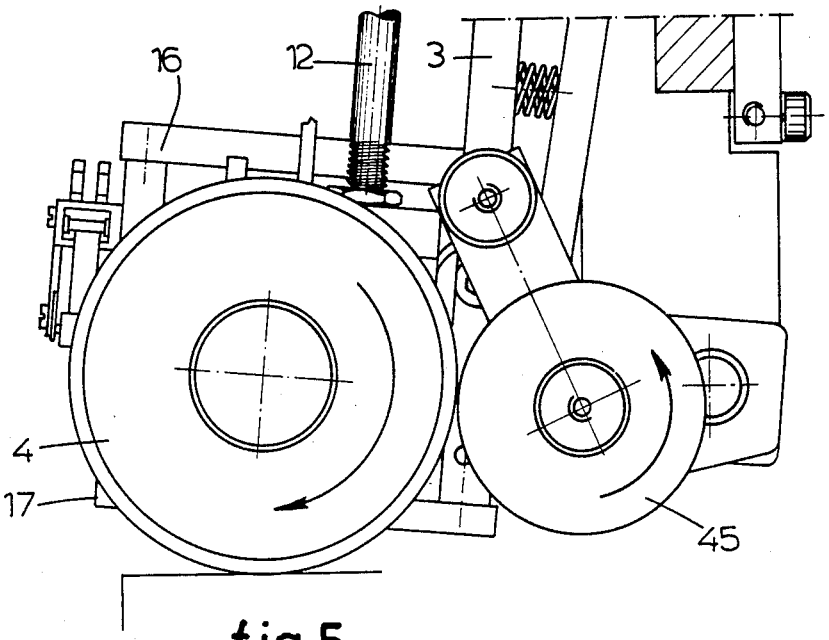
Figure 4:
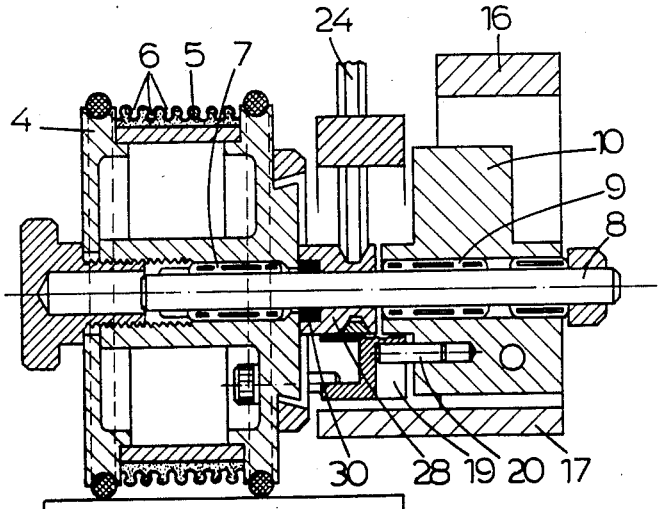
FIG. 4 shows a cross-section according to the line IV—IV of FIG. 1.

FIG. 5 partially shows a side view of the printing apparatus of FIG. 1, wherein the text roll and the inking means can be seen.

Figure 6:
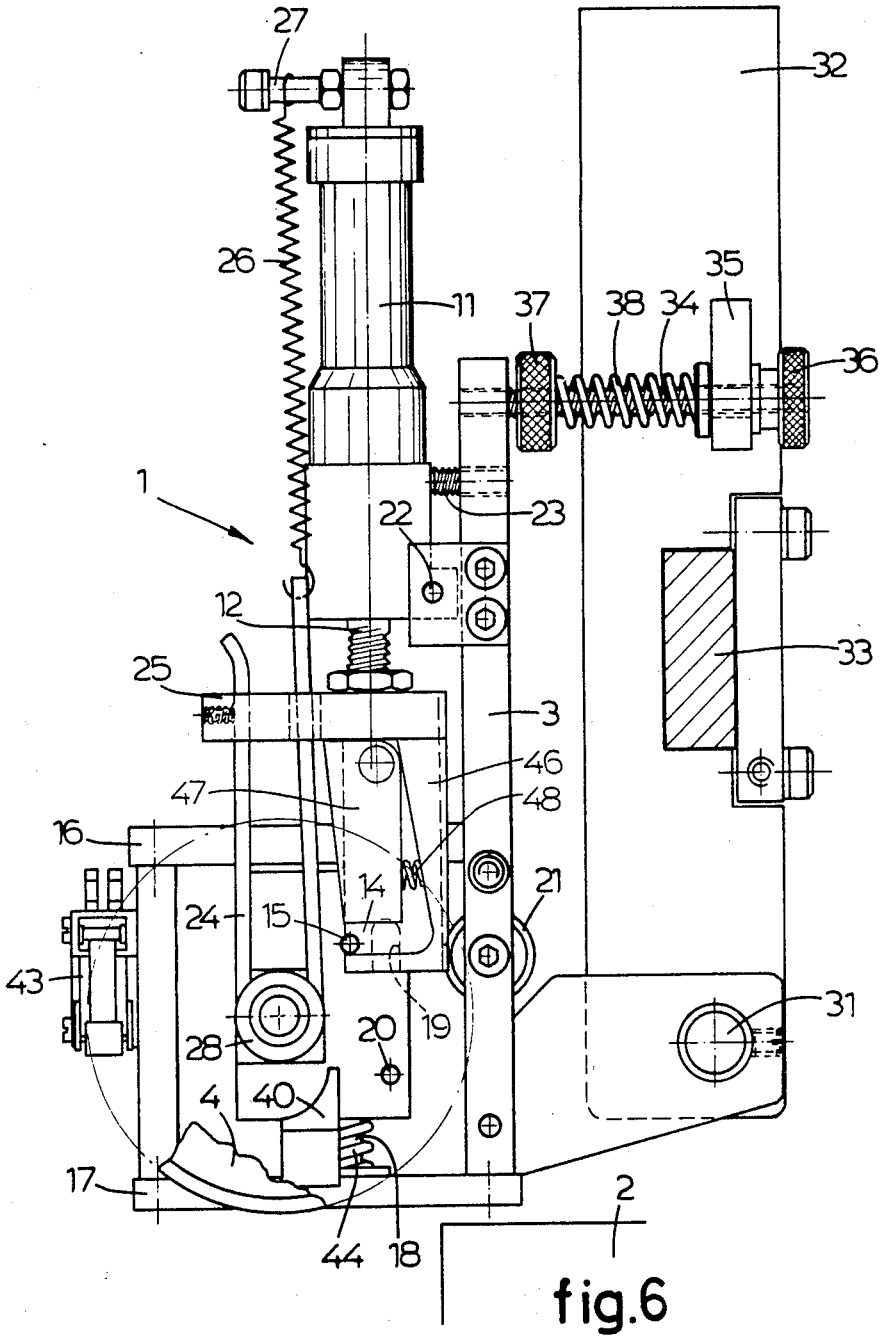

FIG. 6 is a partial side view of the printing apparatus of FIG. 1, wherein an alternative stop block is used.

Referring to the drawings there is shown a printing apparatus 1 for applying a coding on a surface which is transported past the printing apparatus, for example the upper surface of a schematically indicated box 2. The printing apparatus 1 comprises a text roll 4 supported by a frame 3, which text roll 4 can be driven by the passing box 2. The text roll 4 is provided with a peripheral covering 5 with slots 6 in which the desired coding characters can be fixed.

The text roll 4 is rotatably mounted on a shaft 8 by means of a freewheel clutch 7, which shaft 8 is rotatably mounted in a bearing block 10 by means of a freewheel clutch 9. Thereby the text roll 4 and the shaft 8 can only rotate in the direction indicated by an arrow in FIG. 5.

The printing apparatus 1 is further provided with a driving means made as a pneumatic double operating cylinder piston assembly 11, by means of which the text roll 4 is rotatable and movable in radial direction. To this end the piston rod 12 of the cylinder piston assembly 11 is equiped with a stop block 13 movable backwards and forwards, said stop block 13 having a first recess 14 cooperating with a pin 15 carried by the text roll 4. The bearing block 10 is mounted movably in the same direction as the stop block 13 backwards and forwards between an upper plate 16 and a lower plate 17. The bearing block 10 is guided by a guiding rod 18. The bearing block 10 is movable by means of the stop block 13 because the stop block 13 has a recess 19 which cooperates with a pin 20 carried by the bearing block 10. The movement of the stop block 13 is guided by a ball bearing 21 mounted in the frame 3, which ball bearing 21 engages a slot formed in the stop block 13 and indicated by a dotted line. The cylinder piston assembly 11 is supported by the frame 3 rotatably on a pin 22, wherein a bolt 23 exerts a force on the cylinder piston assembly 11 in such a manner that the stop block 13 is pressed against the ball bearing 21.

The stop block 13 is further coupled with the text roll 4 by means of a driving belt 24, one end of which is fixed in a protruding arm 25 of the stop block 13, while the other end is connected with the frame 3 through a spring 26. To this end a protruding pin 27 is fixed at the upper side of the cylinder piston assembly 11. The driving belt 24 is led along a pulley 28 and extends through a bore 29 formed in the arm 25. The pulley 28 is coupled with the shaft 8 of the text roll 4 by means of a friction coupling 30. The friction coupling 30 shown in the drawings consists of an O-ring enclosed between the pulley 28 and the shaft 8. However, the friction coupling can be made in any other suitable manner.

The frame 3 of the printing apparatus 1 is connected with a support arm 32 rotatable on a pin 31, which support arm 32 is mountable on a support 33 mounted above the path of the surface to be coded. The frame 3 carries a bolt 34 one end of which projects through a guiding arm 35 of the support arm 32, which end carries a nut 36. Between the guiding arm 35 and a nut 37 lying on the bolt 34 near the frame 3 lies a spring 35. The frame 3 of the printing means 1 can be pivoted upwardly against the action of the spring 38 by the product to be coded, as will be described hereafter.

The operation of the described printing apparatus will now be explained:

In FIG. 1 the text roll 4 is in a rest position in which the text roll 4 is completely free of the surface to be coded. The rest position is determined by the recess 14 of the stop block 13, the pin 15 of the text roll 4 lying in said recess 14. As soon as a surface to be coded comes up to the text roll, the cylinder piston assembly 11 is energized. Said coming up of a surface to be coded can be detected in case of separate products as the box 2, by means of a detector 39 disposed at a suitable location. For coding packagings which are still contained in a material web an other suitable detector can be used.

Figure 2:
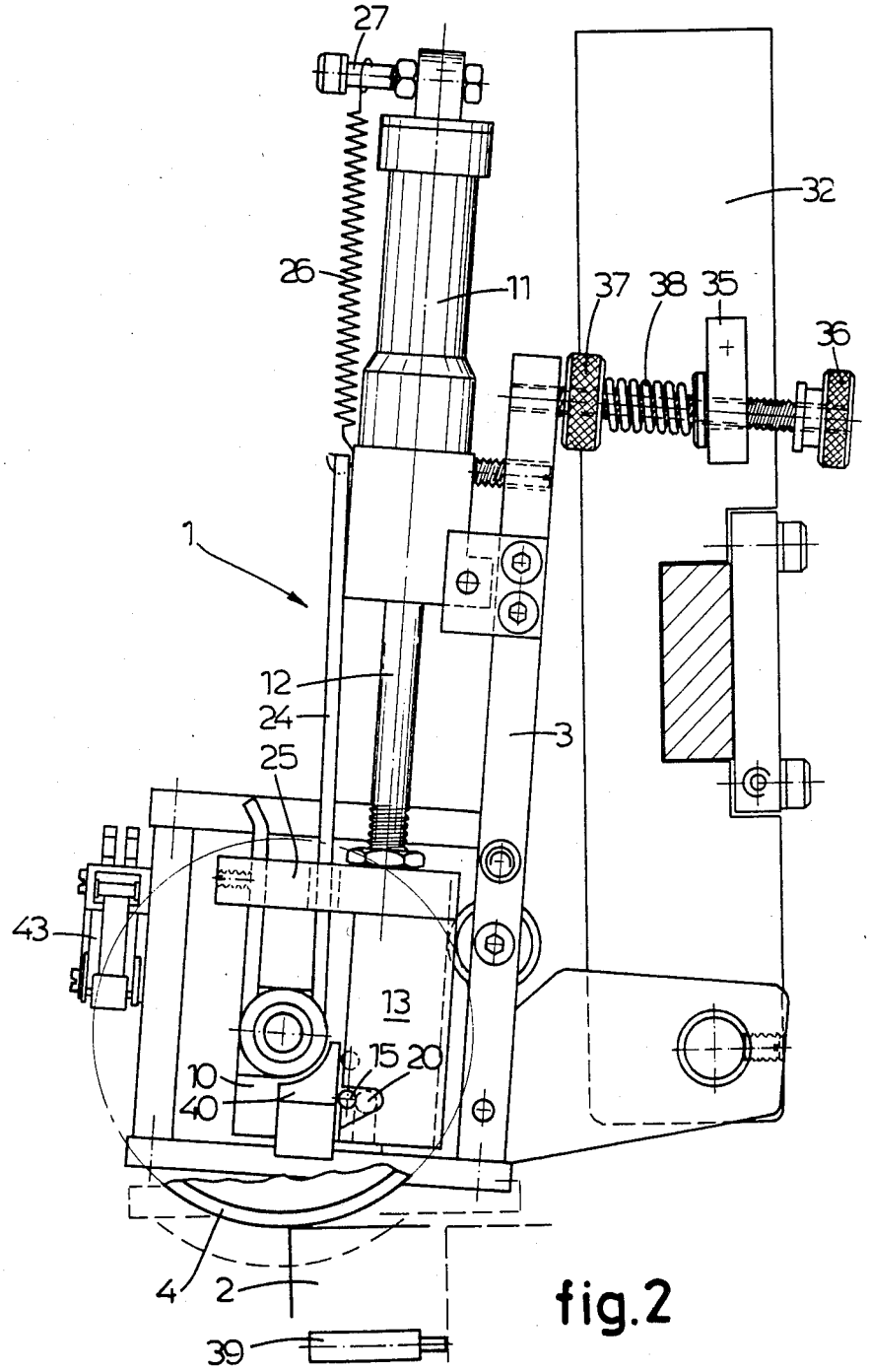
FIG. 2 shows a side view of the printing apparatus corresponding to FIG. 1, wherein the only partially shown text roll is in the working position seen in rotational direction.
Figure 3:
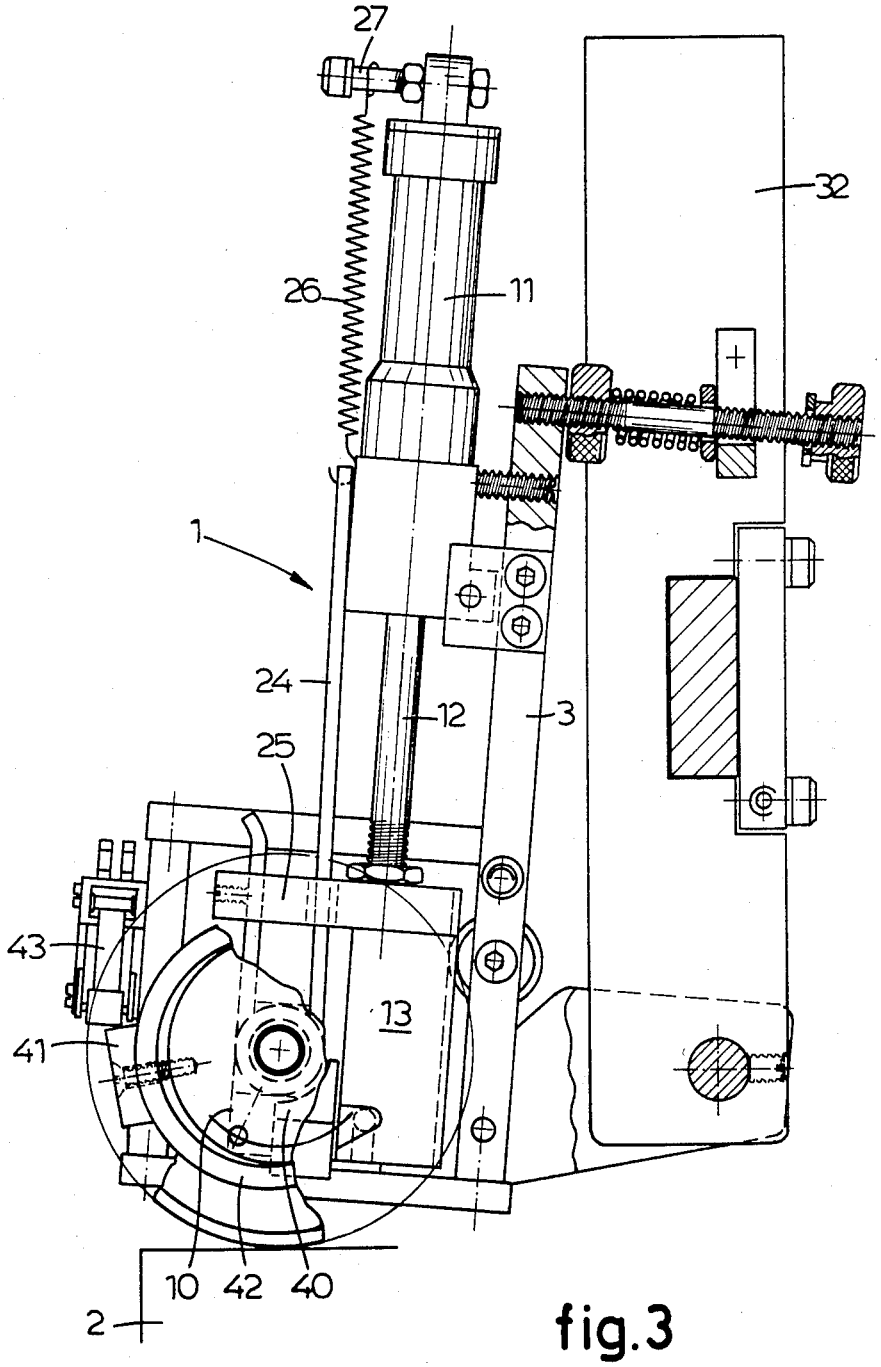
FIG. 3 shows a side view of the printing apparatus corresponding to FIG. 1, wherein the partially shown text roll has substantially reached the end position.

Due to the energizing of the cylinder piston assembly 11 the stop block 13 is moved downwards, wherein the text roll 4 is rotated by means of the pin 15 until the pin strikes a stop 40 carried by the frame 3. During the further downward motion of the stop block 13 the bearing block 10 is also moved downwards by means of the pin 20. Thereby the text roll 4 reaches the working position indicated in FIG. 2 by a dotted line, in which working position the text roll 4 can engage the surface to be coded and the first coding character which lies in radial direction substantially at the location of the pin 15, is in the tangent plane of the text roll 4 and the surface to be coded. As the text roll 4 is moved downwards with the bearing block 10, the pin 15 does not engage the stop 40 anymore, so that the text roll 4 can be rotated by the product. The product 2 will now turn the text roll 4 with the frame 3 upwardly against the action of the spring 38 to the position shown in FIG. 2 in full lines. Thereby the coding characters are pressed on the surface of the product 2 to be coded with a force which is adjustable by means of the nut 37.

As soon as all coding characters are applied on the product, the cylinder piston assembly 11 should be energized for the backward motion. To this end the next roll 4 carries a switching cam 41 fixed on a ring 42 rotatable in circumferential direction and provided at the side of the text roll 4 directed to the bearing block 10. The ring 42 is adjusted in such a manner that the switching cam 41 operates a switching means 43 as soon as the last coding character is applied and thus the text roll 4 is in an end position in respect of the coding operation. The switching means 43 energizes the cylinder piston assembly 11 for the backward motion.

During this backward motion the bearing block 10 is returned by a spring 44 which is provided around the guiding rod 18 between the bearing block 10 and the lower plate 17. Thereby the text roll 4 is disengaged from the coded surface of the product 2. During the further backward motion the shaft 8 is driven by the driving belt 24, so that due to the freewheel clutch 7 the text roll 4 will rotate with the shaft and will finally reach the rest position of FIG. 1. It is not possible that the text roll 4 will rotate backwards due to the occurring reaction forces as this is prevented by the freewheel clutches 7 and 9. The angular distance along which the text roll 4 has to be rotated to reach the rest position depends on the length in circumferential direction of the coding to be applied. The distance along which the driving belt 24 is moved during the backward motion is such that the text roll 4 can reach the rest position under all circumstances. When the text roll 4 only needs to be rotated along a small angular distance in view of the length of the coding to be applied, the pulley 28 can slip with respect to the shaft 8 by the application of the friction coupling 30. During the backward motion of the cylinder piston assembly 11 the frame 3 will be pivoted to the position of FIG. 1 by the spring 38.

In case of a coding with such a length in the circumferential direction that the text roll 4 needs only to be rotated over a very small angular distance to the rest position it could happen at the embodiment of FIG. 1 that the pin 15 will strike the stop block 13 before this stop block 13 has reached its rest position so that the pin 15 would not be received in the recess 14 in the manner desired. FIG. 6 shows an alternative embodiment of the printing apparatus 1 which mainly corresponds to the embodiment of FIG. 1, wherein however a modified stop block 46 is provided. The stop block 46 comprises a pawl 47 which is pivotable against the action of a spring 48. The movable end of the pawl 47 adjoins the recess 14. If the pin 15 of the text roll 4 would strike the stop block 46 before this stop block 46 has reached its rest position, the pin 15 will now be resiliently received by the pawl 47. The pin 15 can reach the recess 14 due to the pivotable mounting of the pawl 47.

As shown in FIG. 5 the printing apparatus 1 is provided with a rotatable inking means 45 for inking the coding characters disposed on the text roll 4. Seen in the rotational direction of the text roll 4 the inking means 45 is located between the rest position and the working position of the text roll 4. Thereby the first coding characters are already inked during rotating the text roll 4 from the rest position to the working position.

From the foregoing it will be clear that at the described printing apparatus 1 due to the application of the cylinder piston assembly 11 the text roll 4 can be quickly brought in the working position and, after coding, can be quickly brought into the rest position again from the end position reached by the coding. Thereby the printing apparatus 1 is able to apply a great number of codings per minute. Experiments have shown that the printing apparatus 1 can apply about 400 codings per minute, whereas the known printing apparatus having a text roll can apply 50 codings per minute at the utmost. Because the text roll is movable backwards and forwards in radial direction by the cylinder piston assembly 11 the size of the text roll can be chosen independent of the surface to be coded, while the printing apparatus is moreover adapted to apply codings on packagings which are still contained in a material web.

It is noted that for applying codings on a material web said material web should be led along a supporting roller at the location of the printing apparatus 1.

The invention is not restricted to the above-described embodiments which can be varied in a number of ways within the scope of the invention.

For example the pneumatic cylinder piston assembly 11 can be replaced by any other suitable driving means.

I claim:

1. Printing apparatus for applying a coding on a surface which is transported past the printing apparatus, comprising a text roll for the coding characters supported by a frame and rotatably mounted on a shaft, which text roll can be driven by the passing surface, and a rotatable inking means for inking the coding characters, wherein the text roll is movable backwards and forwards in radial direction, and a driving means is provided for rotating the text roll and moving the text roll in radial direction from the rest position, in which the text roll is completely free of the surface to be coded, to a working position, in which the text roll engages the surface to be coded, when a surface to be coded comes up to the text roll, and in that the driving means is adapted to return the text roll in radial direction and to rotate the text roll to the rest position from an end position reached by the coding operation after applying the coding, wherein the driving means operates a stop block movable backwards and forwards, said stop block having a first recess adapted to cooperate with a pin of the text roll, wherein the shaft of the text roll is borne in a bearing block movable backwards and forwards in the same direction as the stop block, said bearing block being movable by the stop block, wherein said stop block is adapted to rotate the text roll to the working position by means of the pin during the forward motion and to move the bearing block together with the text roll during the last part of the forward motion whereas the bearing block is returned by a return means during the first part of the backward motion of the stop block, the stop block further being coupled by a coupling member to the text roll for rotating the text roll to the rest position determined by said recess during the remaining part of the backward motion.

2. Printing means according to claim 1, wherein the stop block is provided with a pawl pivotable against the action of a spring, the movable end of the pawl adjoining the recess, said pawl being adapted to cooperate with the pin of the text roll during the backward motion of the stop block.

3. Printing apparatus according to claim 1, wherein the text roll is borne rotatably in one direction on the shaft by means of a freewheel clutch, which shaft is borne rotatably in the same direction in the bearing block by means of a freewheel clutch, wherein a pulley is mounted on the shaft and a driving belt is led along the pulley, one end of the driving belt being connected with the stop block, the other end being connected with the frame through a spring.

4. Printing apparatus according to claim 3, wherein the pulley is coupled with the shaft by means of a friction coupling.

5. Printing apparatus according to claim 1, wherein the frame carries a stop for the pin of the text roll, said stop determining the working position of the text roll in the rotational direction, wherein the pin can pass the stop when the bearing block has been moved to the working position.

6. Printing apparatus according to claim 1, wherein said return means for the bearing block is made as a compression spring.

7. Printing apparatus according to claim 1, wherein the text roll carries a switching cam adjustable in the circumferential direction, by means of which switching cam a switching means for energizing the driving means is operable in the end position of the text roll.

8. Printing apparatus according to claim 1, wherein the driving means consists of a double operating cylinder piston assembly.

9. Printing apparatus according to claim 1, wherein the frame is rotatably connected to a supporting arm, wherein the frame is rotatable with respect to the support arm against the action of a spring.

10. Printing apparatus according to claim 1, wherein the inking means is located in rotational direction of the text roll between the rest position and the working position.

* * * * *